US006029378A

United States Patent [19]

Cronk, Jr.

[11] Patent Number: 6,029,378

[45] Date of Patent: Feb. 29, 2000

[54] APPARATUS FOR PADDING UNDERGROUND CONDUITS

[76] Inventor: Thomas J. Cronk, Jr., P.O. Box 11189, Odessa, Tex. 79760

[21] Appl. No.: 08/962,401

[22] Filed: Oct. 31, 1997

[51] Int. Cl.[7] ..... E02F 5/22; B07B 1/06

[52] U.S. Cl. ..... 37/142.5; 405/179; 209/283; 209/300

[58] Field of Search ..... 37/142.5; 405/154, 405/179; 209/281, 283, 284, 285, 286, 300

[56] References Cited

U.S. PATENT DOCUMENTS

| | | | |
|---|---|---|---|
| 1,004,715 | 10/1911 | Valiquett et al. . | |
| 1,220,197 | 3/1917 | Cowles . | |
| 1,658,398 | 2/1928 | Seaman . | |
| 1,860,481 | 5/1932 | Royer . | |
| 2,618,439 | 11/1952 | Malone | 241/101 |
| 2,744,739 | 5/1956 | Evans et al. | 262/2 |
| 2,814,387 | 11/1957 | McWilliams | 209/247 |
| 2,843,330 | 7/1958 | Gundlach | 241/230 |
| 2,857,691 | 10/1958 | Curran | 37/144 |
| 2,879,952 | 3/1959 | Pollitz et al. | 241/235 |
| 2,947,096 | 8/1960 | Cummings et al. | 37/144 |
| 2,974,795 | 3/1961 | Behnke et al. | 209/247 |
| 3,011,640 | 12/1961 | Hoiness | 209/283 |
| 3,059,775 | 10/1962 | Rothery | 209/284 |
| 3,190,571 | 6/1965 | Kimball | 241/230 |
| 3,199,798 | 8/1965 | Turner, Jr. | 241/242 |
| 3,249,220 | 5/1966 | Bakke | 209/283 X |
| 3,314,175 | 4/1967 | Petty et al. . | |
| 3,365,050 | 1/1968 | Taylor | 198/120.5 |
| 3,396,481 | 8/1968 | Hovorak | 37/108 |
| 3,478,972 | 11/1969 | Hansen | 241/230 |
| 3,568,626 | 3/1971 | Southworth, Jr. | 116/114 |
| 3,596,384 | 8/1971 | Neujahr | 37/142.5 |
| 3,647,150 | 3/1972 | Stephanek | 241/75 |
| 3,701,422 | 10/1972 | Downey | 209/241 |
| 3,823,819 | 7/1974 | Bakke | 209/283 X |
| 3,860,291 | 1/1975 | Rauch et al. | 299/67 |
| 3,981,089 | 9/1976 | Burrows | 37/195 |
| 3,984,151 | 10/1976 | Altmayer | 308/15 |
| 3,999,399 | 12/1976 | Maurer | 61/54 |
| 4,057,917 | 11/1977 | Burrows | 37/42.5 |
| 4,192,471 | 3/1980 | Beckman et al. | 241/185 R |
| 4,221,505 | 9/1980 | Taylor-Smith | 405/303 |
| 4,301,910 | 11/1981 | Price | 198/304 |
| 4,329,084 | 5/1982 | Chapa | 405/157 |
| 4,377,365 | 3/1983 | Layh | 414/334 |
| 4,396,797 | 8/1983 | Sakuragi et al. | 174/68 C |
| 4,588,033 | 5/1986 | Orthman | 171/62 |
| 4,623,282 | 11/1986 | Allen | 405/157 |
| 4,633,602 | 1/1987 | Layh et al. | 37/195 |
| 4,699,838 | 10/1987 | Gilbert | 428/201 |
| 4,808,031 | 2/1989 | Baker | 405/168 |
| 4,861,461 | 8/1989 | Utterback | 209/234 |
| 4,874,648 | 10/1989 | Hill et al. | 428/35.9 |
| 4,877,660 | 10/1989 | Overbergh et al. | 428/34.9 |
| 4,879,162 | 11/1989 | Hansen, Sr. | 428/196 |
| 4,909,669 | 3/1990 | Baker | 405/168 |
| 4,912,862 | 4/1990 | Bishop et al. | 37/142.5 |
| 4,948,299 | 8/1990 | Cronk, Jr. et al. | 405/179 |
| 4,955,756 | 9/1990 | Klamar | 405/179 |
| 5,084,991 | 2/1992 | Cronk, Jr. | 37/142.5 |
| 5,097,610 | 3/1992 | Bishop | 37/142.5 |
| 5,099,889 | 3/1992 | Ratzlaff | 138/110 |
| 5,102,265 | 4/1992 | Dokmo et al. | 405/216 |
| 5,120,433 | 6/1992 | Osadchuk | 209/235 |
| 5,154,364 | 10/1992 | Ketting | 241/37 |
| 5,242,246 | 9/1993 | Manchak, III et al. | 405/128 |
| 5,245,768 | 9/1993 | Purkeypile | 37/347 |
| 5,259,699 | 11/1993 | Klamar | 405/179 |
| 5,261,171 | 11/1993 | Bishop | 37/142.5 |
| 5,445,330 | 8/1995 | Shokey Rashwan et al. | 241/78 |
| 5,490,742 | 2/1996 | Cronk | 405/157 |
| 5,694,709 | 12/1997 | Cronk, Jr. et al. | 37/142.5 |

FOREIGN PATENT DOCUMENTS

| | | | |
|---|---|---|---|
| 382760 | 10/1923 | Germany | 209/283 |

*Primary Examiner*—H. Shackelford
*Attorney, Agent, or Firm*—Arnold, White & Durkee

[57] ABSTRACT

The present invention provides an apparatus for constructing bottom pads, or bench pads, as well as for padding a pipeline during construction. To pad the bottom of a pipeline, a padder is removably attached to one end of a conventional excavator or other base machine or vehicle, whereby a portion of the padder is inserted in the backfill and extracts padding material of a maximum predetermined size.

21 Claims, 8 Drawing Sheets

APPARATUS FOR PADDING UNDERGROUND CONDUITS

BACKGROUND OF THE INVENTION

1. Field of the invention

This invention relates generally to earth and material handling equipment. More particularly, it relates to an improved apparatus for providing padding material during the installation of an underground pipeline or other conduit, including creating bottom pads, or bench pads, from the excavated material that results from digging a trench or other cavity.

2. Description of the related art

Underground pipelines are typically used to transport matter from one location to another. Such piping is commonly coated with plastic or an equivalent protective substance to prevent it from corroding while it is in the ground. It is necessary that the piping be buried in such a way as not to dent or damage the pipe and especially the protective coating. This is typically done by placing a layer of fine soil or sand, commonly called padding material, immediately adjacent the exterior surface of the pipe prior to covering the pipe line trench with material previously excavated from the trench. This excavated material typically contains rocks which can damage the pipe if placed directly in contact with the pipe surface.

To lay such pipe, a ditch digger, backhoe or the like is used to dig an open trench. The excavated rocks and soil, often referred to as spoil or backfill, is typically piled to one side of the excavation forming a continuous mound running parallel to the trench. Before the pipe is placed in the trench, it is customary that a series of small bottom pads composed of padding material be spaced along the bottom of the trench. The pipe is then placed upon these pads and supported above the trench bottom at spaced intervals. This enables additional padding material to be placed completely around and under the pipe after the pipe is placed in the trench. Historically, the bottom pads, or bench pads, are typically done by hand. This entails a labor intensive process that can not only be expensive and time consuming but can be a substantial safety hazard for workers standing in the ditch since the ditch can be several feet deep and subject to collapse in certain soil conditions.

Once the pipe is placed in the trench and supported by the spaced bench pads, a pipeline padding machine, such as that disclosed in U.S. Pat. No. 5,084,991, may then be driven longitudinally along the side of the trench through the spoil to collect and process the excavated material to partially fill the trench with fine padding material that is separated out of the excavated spoil. It is preferred to extract the fine material out of the spoil so that the remaining coarse particles in the spoil do not come into direct contact with the pipe surface, which can damage the coating and cause undesirable damage or corrosion of the pipeline.

U.S. Pat. No. 2,857,691, which issued Oct. 28, 1958 to Donald Michael Curran, and is entitled "Pipeline Ditch Filling and Pipe Padding Machine," is directed to obtaining and depositing padding material from the spoil to the trench. This patent discloses the use of a rotating head to collect and elevate excavated material and extract fine material (i.e. fines) from the spoil and a conveyor to carry the fines to the trench. However, Curran discloses an arm which extends across the ditch and is moved longitudinally through the spoil along the side of the trench and elevates excavated material and extracts some of the material as the entire device moves along the trench to provide a continuous supply of padding material. As a result, such devices have been found to be very difficult to control and operate due to the lateral torque placed upon the extended arm and the tractor. Also, the continuous nature of the device makes the formation of a single bench pad somewhat difficult and would possibly require that the device be forced through the spoil twice—once to form bench pads and a second time to provide additional padding material around the pipe. The additional stress on these devices tends to reduce the duration for which they can be utilized. A shorter life span of such padding devices also makes the process of constructing bench pads expensive.

In addition to a need for a more economical process of constructing bench pads, there is a need for a padder that is adaptable to various types of terrain, especially in places that are difficult for existing padding machines to access.

The present invention is directed to overcoming, or at least reducing the effects of, one or more of the problems set forth above.

SUMMARY OF THE INVENTION

In one aspect of the present invention, a padder is provided for padding which includes a housing having a front and rear end, an inlet, and a first outlet. The front end of the housing may be inserted directly into a backfill to at least partially cover the inlet with backfill material; allowing at least an extracted portion of the backfill material to pass through the screened inlet; a conveyor to transport the extracted portion toward the rear end of the housing; and allowing at least a first portion of the extracted portion to pass through the first outlet into the open trench.

In another aspect of the present invention, an apparatus includes a housing having a front and rear end. An inlet assembly defined in the housing proximate the front end which is adapted to being forced into the backfill material, the backfill material including particles having a plurality of sizes. A first outlet assembly is defined in the housing between the inlet and the rear end of the housing. A conveyor is mounted in the housing of the padder to transport an extracted portion of the backfill material which enters the device to be used as padding material.

BRIEF DESCRIPTION OF THE DRAWINGS

Other objects and advantages of the invention will become apparent upon reading the following detailed description and upon reference to the drawings in which.

Figure 1A:
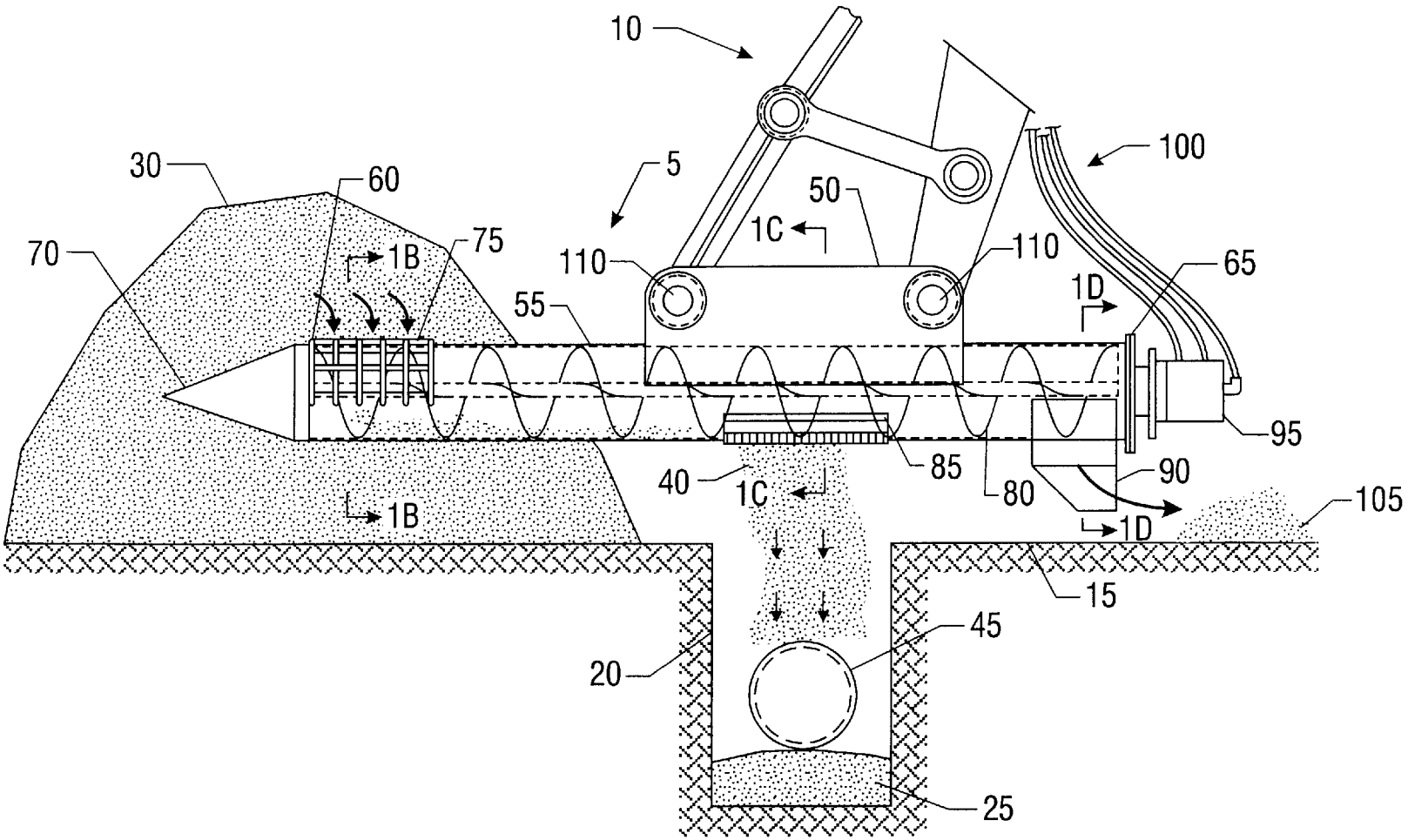
FIG. 1A is a side elevational view of a padder constructed according to one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Detailed Description of Specific Embodiments

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Overview

The present invention provides an apparatus for constructing bottom pads, or bench pads, as well as for providing lager amounts of padding material for a pipeline. To construct bench pads from the spoil material to support the bottom of a pipeline, the padder is removably attached to one end of the boom of a conventional excavator or other primer mover or vehicle, whereby one end of the padder is forced into the backfill at a particular place and extracts suitable padding material from the mound of spoil without lateral motion along the length of the backfill while operating. The remaining portion of the pipeline may also be padded with the apparatus of the present invention by repeatedly placing the first end of the device into and out of the spoil while periodically moving the subject invention along the trench. Also, under certain conditions, the device may be probed through the backfill material in parallel to the open trench as will be explained in more detail below.

First Embodiment

Referring now to the drawings, and particularly to FIG. 1A, a padder 5 for conventional padding or constructing bench pads according to one embodiment of the invention is illustrated. As shown, the padder 5 is longitudinally mounted to the end of a boom of a conventional excavator (not shown), which is positioned on the working side 15 of a pipeline trench 20. A bench pad 25 is formed on the bottom of the trench 20 using extracted material 35 from a supply of backfill 30 material. When a pipeline 45 is subsequently placed in the trench 20, it is supported by spaced bench pads 25 with selected intervals of the pipe 45 being spaced above the bottom surface of trench 20. Such spaced support of the pipe 45 allows additional padding material to be added later to encircle the entire outside of pipe 45 when added by a continuous padding machine.

The padder 5 is mounted to the excavator 10 using a bracket of two parallel, rectangular panels 50, which are affixed to the padder 5 on each side and are adapted to connect to a boom 10 of the excavator. The rectangular panels 50 are pivotally mounted by pins 110 to the excavator boom 10 whereby the padder 5 can be maneuvered as desired by the boom operator. Those skilled in the art will appreciate that the panels 50 can be attached to padder 5 in various ways, including welding, bolts, rivets or the like.

The padder 5 comprises a substantially cylindrical housing 55 with a first or distal end portion 60 and a second or proximal end portion 65, a tapered or substantially conical shaped head 70 fixed to the first end portion 60, an inlet grizzly assembly 75 positioned toward the first end portion 60, a conveyer assembly, shown as an auger 80, coaxially disposed within the cylindrical housing 55, a first outlet and screen assembly 85, and a second outlet 90. The head 70 of the padder 5, as well as the inlet 75, may be inserted directly into the backfill material 30 with the excavator vehicle remaining on the opposed side of the open trench 20 so that the first end of the housing and head 70 penetrates into the extracted backfill material 35 to a sufficient depth so as to allow the excavated material to pass through the large grid grizzly assembly 75 and into the internal chamber of housing 55 of the padder 5. Such extracted material 35 is then transported down the length of the padder 5 by the rotating auger 80. The auger 80 may be driven by a hydraulic motor 95, which is coupled to the auger 80 and powered by hydraulic lines 100 of the hydraulic system of the excavator.

As the extracted material 35 is moved along the length of the padder 5, it passes over the first outlet assembly (i.e. outlet opening and screen) 85, which may be located in a central, bottom section of the padder 5 between ends 60, 65. The outlet grid or screen assembly 85 is sized to allow only material 40 suitable for pipeline padding to pass through the openings of the grid while retaining within the housing 55 all other larger residual pieces of material. The residual material continues to be transported by the auger along the length of housing 55 toward the second end 65 of the padder 5. There, this residual material passes through the rear outlet 90 and discharged, and may be either deposited on the ground near the trench 20 or placed on a conveyor (not shown in FIG. 1A) and transported to a remote location.

Figure 1B:
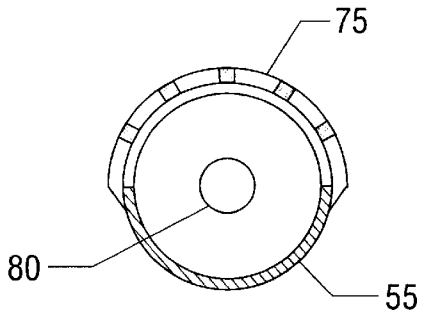
FIG. 1B is a cross sectional view taken along the line 1B—1B of FIG. 1A.
Figure 1C:
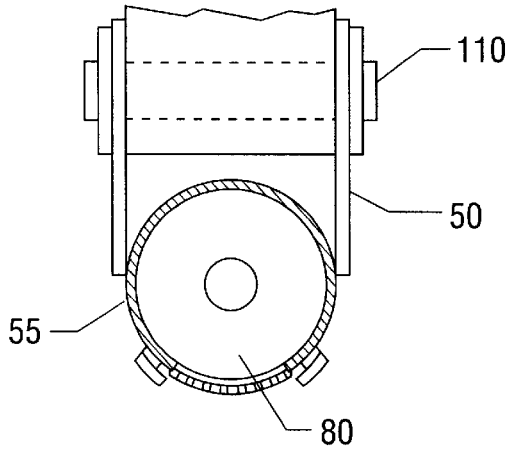
FIG. 1C is a cross sectional view taken along the line 1C—1C of FIG. 1A.
Figure 1D:
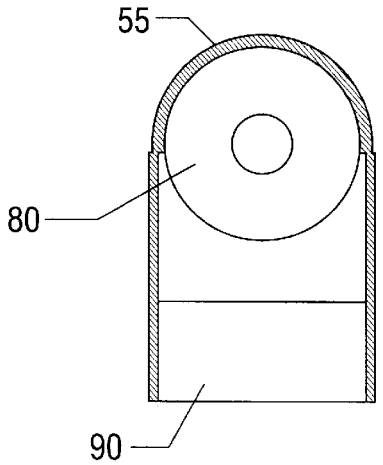
FIG. 1D is a cross sectional view taken along the line 1D—1D of FIG. 1A.

The inlet grizzly or screen assembly 75 and outlet grid assembly 85 may be an opening or port formed in the housing 55 with a rigid screen or grid attached across the opening, the grid having a plurality of openings selectable to be of a size for processing the backfill material 30 having a preselected maximum size. The rear outlet 90 is an opening formed is the housing large enough to discharge oversized, coarser material which passed through screen 75 but is too large to pass through screen 85. FIGS. 1B–D show the cross sectional views of the inlet grizzly assembly 75, outlet grid assembly 85, and rear outlet 90, respectively.

The bench pads 25 can be formed with the apparatus of the present invention by pivotally attaching the padder 5 in a longitudinal manner to a conventional excavator boom or other base machine or vehicle. The head 70 and first end 60 of pipeline padder 5, which protrudes outward from the base machine, is forced into and pierces into the backfill material 30 at a selected location along the trench. As can be understood, head 70 may be shaped in a manner other than conical so long as it may be effective forced into and penetrate the spoil material. Such shapes may include without limitation any tapered shape such as conical, chisel shape, pyramidal or ogive. An amount of padding material, the extracted material 35, passes through inlet 75 as the head 70 is forced into the spoil bank 30. Typically, the padder is not moved laterally along the length of the backfill material 30 while the end 60 is embedded within the spoil 30. Once the padder conveyor has been operated for a sufficient time, the bottom pad 25 in the trench 20 is formed, or sufficient padding material has been placed in a particular spot. End 60 of padder 5 is then completely withdrawn from the backfill material 30 and the base vehicle (not shown) and padder 5 are moved to another location along the trench where end 60 of padder 5 is once again inserted into the backfill material 30 for extracting padding material and depositing it at a specific location along the trench 20 to deposit a desired amount of padding material.

As can be appreciated, the present invention could include more than one padder 5 mounted to a single boom 10 of a base vehicle. Such multiple padders 5 would be mounted such that the housings 55 of the padders are positioned and fixed parallel to one another, such that the ends 60 of the padders could be simultaneously inserted into the spoil material with a single movement of the boom 10. Such multiple padders could be used to provide increased volumes of padding material when needed.

Also, as can be understood, the present invention can be used to place a continuous layer of padding material along the bottom of the trench before the pipe is positioned in place of the previously mentioned spaced bench pads. Use of multiple padder devices attached to a single boom is believed to be sufficient for such an application.

There are several distinct advantages offered by the apparatus of the present invention in padding operations or constructing bench pads 25 for a pipeline 45. First, because it is not necessary that the padder 5 move laterally once extended into the backfill material 30, there is little lateral torque placed on the padder 5 or the base vehicle (not shown) carrying the padder 5. The padder 5 and the base vehicle (not shown) are thus subjected to reduced external forces while operating, which ultimately tends to extend their life. Second, the method and apparatus of the present invention is adaptable to various types of terrain, and is especially useful for padding portions of a pipeline 45 that are not easily accessible to other conventional padding machines such as, for example, those machines that must travel through the spoil bank as opposed to the working side of the trench. Third, the present invention facilitates the process of spot padding, which, for example, may be necessary at pipeline crossings or locations where the trench is unusually wide and additional padding material is needed.

Second Embodiment

Figure 2:
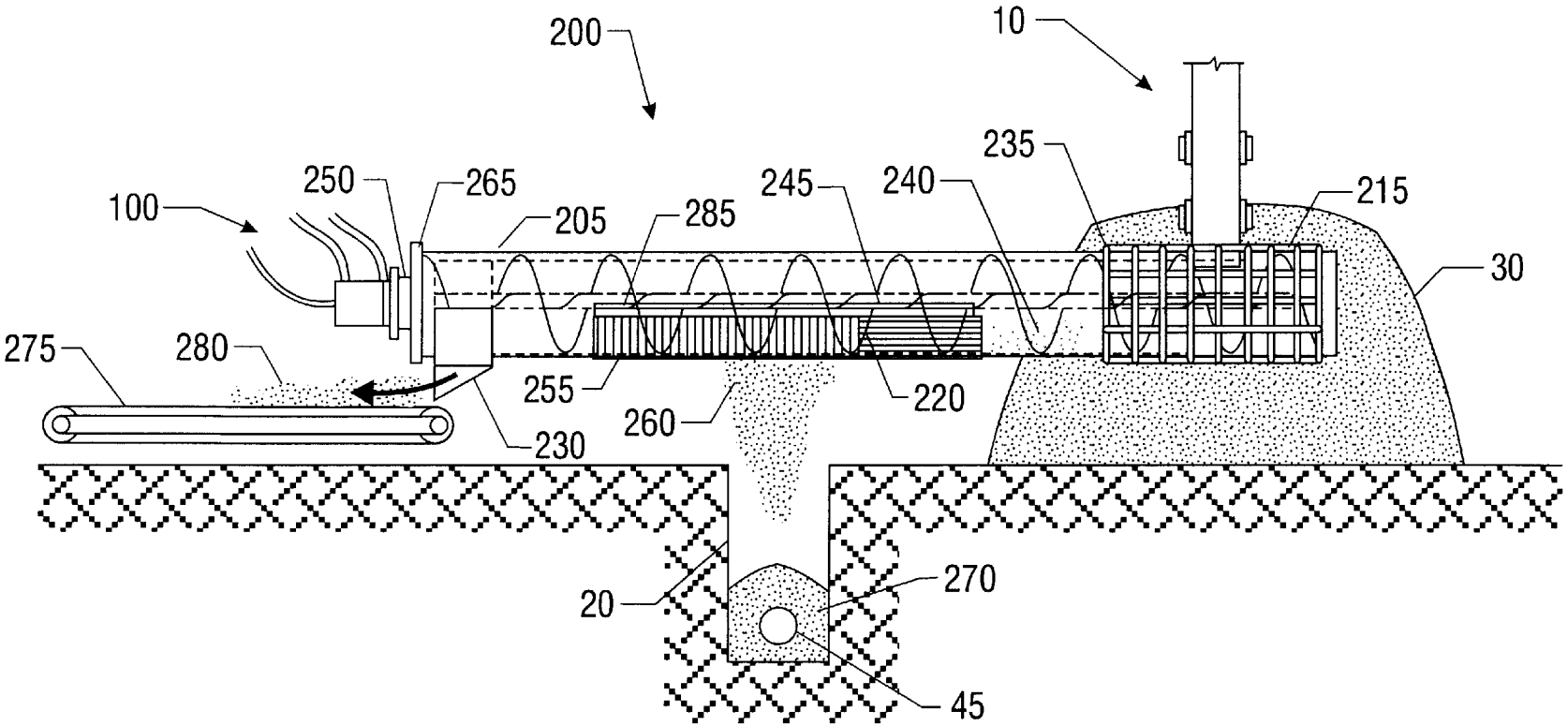
FIG. 2 is a side elevational view of a padder constructed according to another embodiment of the present invention.

FIG. 2 illustrates another embodiment of the present invention. In this embodiment, padder 200 may be used more like a conventional padding machine which works directly in the spoil bank rather than a bench or spot padder. As shown in FIG. 2, the padder 200 is attached to the front end of a prime mover (not shown), near the first end 235 of the padder 200, which works directly in the backfill material 30. Extracted material 240 from the backfill 30 which enters padder 200 is used to deposit padding material to around the pipeline 45 in the trench 20.

The padder 200 comprises an enlongated cylindrical-shaped housing 205 with an internal chamber which encloses a conveyor such as a rotatable auger 210, and also includes an inlet screen or grizzly assembly 215 at a first or inlet end 235, a first outlet assembly 220, and a second (or a rear) outlet 230. The inlet end 235 of the padder 200 may be "pushed" or otherwise forced through the backfill material 30 along the open trench 20 such that the appropriately sized backfill material 240 passes through the large screen or grid assembly 215 and into the chamber of housing 205 of the padder 200. Padder 200 may be forced through the backfill material 30 by attaching the padder to the end of a boom 10 of a standard track excavator or attached to the front of a tractor or dozer (not shown). Inside the housing 205, the auger 245 is rotated so as to move the extracted material 240 along the length of the padder 200 toward second outlet 230. The auger 245 may be driven by a motor such as an hydraulic motor 250 which is coupled to the hydraulic lines 100 of the prime mover that is carrying the pipeline padder 200.

Figure 3:
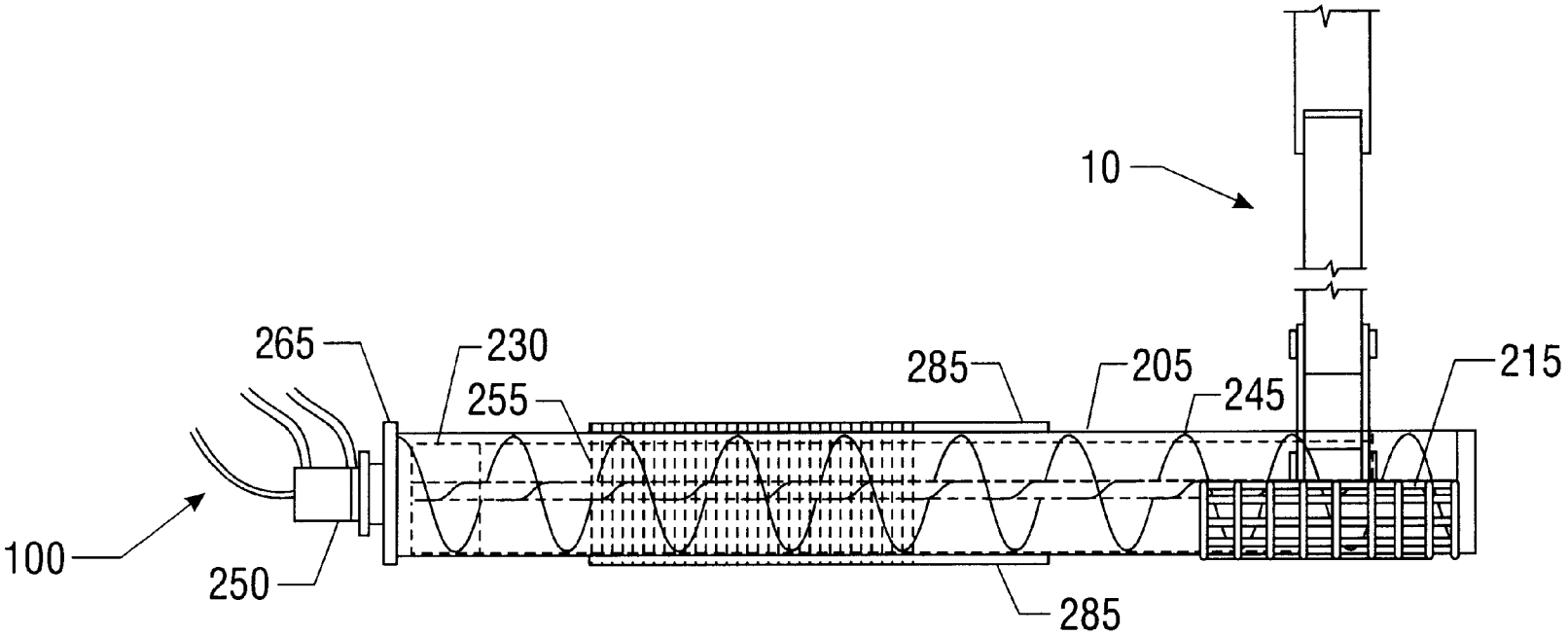
FIG. 3 is a top view of the padder illustrated in FIG. 2.

As the backfill material 240 is conveyed along the length of the housing 205 by the auger 245, it passes over movable grate 255 of outlet assembly 220. An outlet port has been formed in the lower portion of housing 205 with screen or grate 255 positioned over the port as shown in FIG. 2. The appropriately sized backfill material 260, or fines, which are smaller than the openings of grate 255 pass through the openings of movable grate 255 into the open trench 20, placing padding material 270 in the trench around the pipeline 45. The portion of the backfill material 280 that is too large to pass through the openings of movable grate 255, if any, continues to be moved by auger 245 to end 265 of the padder 200. There this larger material is discharged through the rear outlet 230 and onto the ground. Optionally, a conveyor 275 may be mounted beneath the rear outlet opening 230 such that the oversized material 280 may be transported a further distance away from the open trench 20 to avoid the likelihood that it may fall into the trench during padding operations. FIG. 3 depicts a top view of the illustration shown in FIG. 2.

Inlet grizzly or screen assembly 215 positioned near first end 235 includes an inlet port or opening formed in the housing 205 and, of sufficient size to permit sufficient backfill material of appropriate size to pass through the assembly and onto the auger 220 inside housing 205. Assembly 215 includes a sized, rigid grid or grizzly which may be removably attached to housing 205 and positioned across the inlet port or opening. The grizzly includes openings between the grid bars which control the size of the backfill material that passes into housing 205 by excluding pieces of backfill material that is larger than the individual openings of the grizzly. As can be understood, it may be desirable to removably attach the grizzly to the housing so that the user may easily replace the grizzly with an alternative grizzly having different size openings so that the user may vary the maximum size of backfill material that may be accepted by the inlet assembly 215. Such an assembly is equally applicable to the inlet assembly 75 of the embodiment of FIG. 1.

As can be understood from an examination of FIG. 2, the inlet grizzly assembly 215 of this embodiment is formed along one side of the housing 205 such that the opening or port is positioned to receive material as the first end 235 is forced through the backfill material. The embodiment of FIG. 1, on the other hand, has the inlet grizzly assembly 75 positioned along the top of the housing 55 to enable the backfill material to fall downwardly into the housing chamber as first end 65 is inserted into the backfill material.

The first outlet assembly 220 of FIG. 2 includes a removable screen or grate 255 mounted to a central bottom portion of the padder 200 over a first outlet port in housing 205. As can be seen in FIG. 2, the grate 255 may be slideably connected to two external rails 285, which are attached to the outer surface of housing 205. Such a construction enables the grate to be easily removed and replaced with an alternative screen with different size openings, thereby allowing the user to vary the size of padding material provided. The moveable grate 255 can also be selectively positioned along the rails 285 such that the specific point of discharge from the padder 200, or the width of the padding material stream exiting housing 205 may be varied by sliding the grate 255 along rails 285. In the illustrated embodiment, the opening 220 in the housing 205 is about the same length as grate 255 so that the grate 255 may be shifted to alter the point of deposition if grid openings of grate 255 are formed only in a portion of grid 255 and a portion of grate 255 (preferably toward at least each end) does not include openings thereby selectively retaining material except for a moveable area corresponding to the grid openings.

Figure 5A:
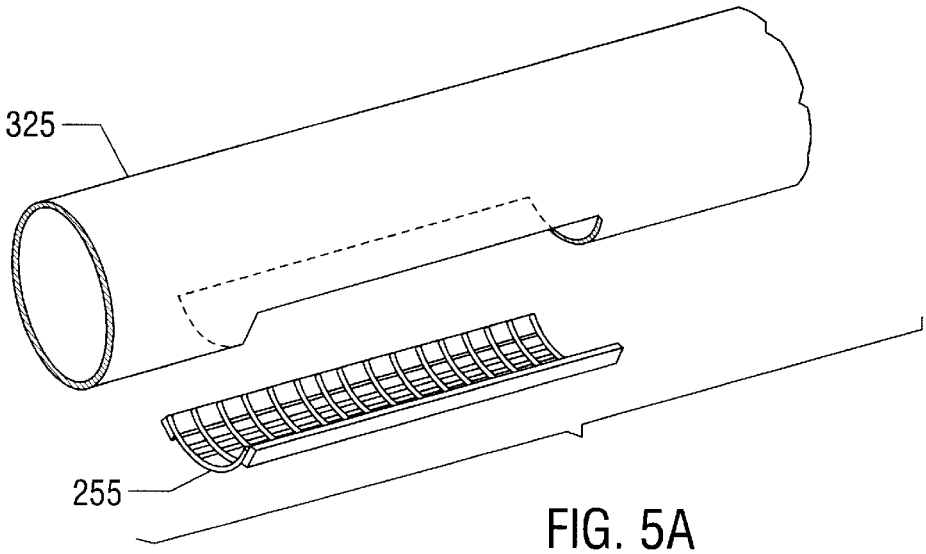
FIGS. 5A–B are isometric views of alternative embodiments of the movable grate of the padder of FIG. 2.
Figure 5B:
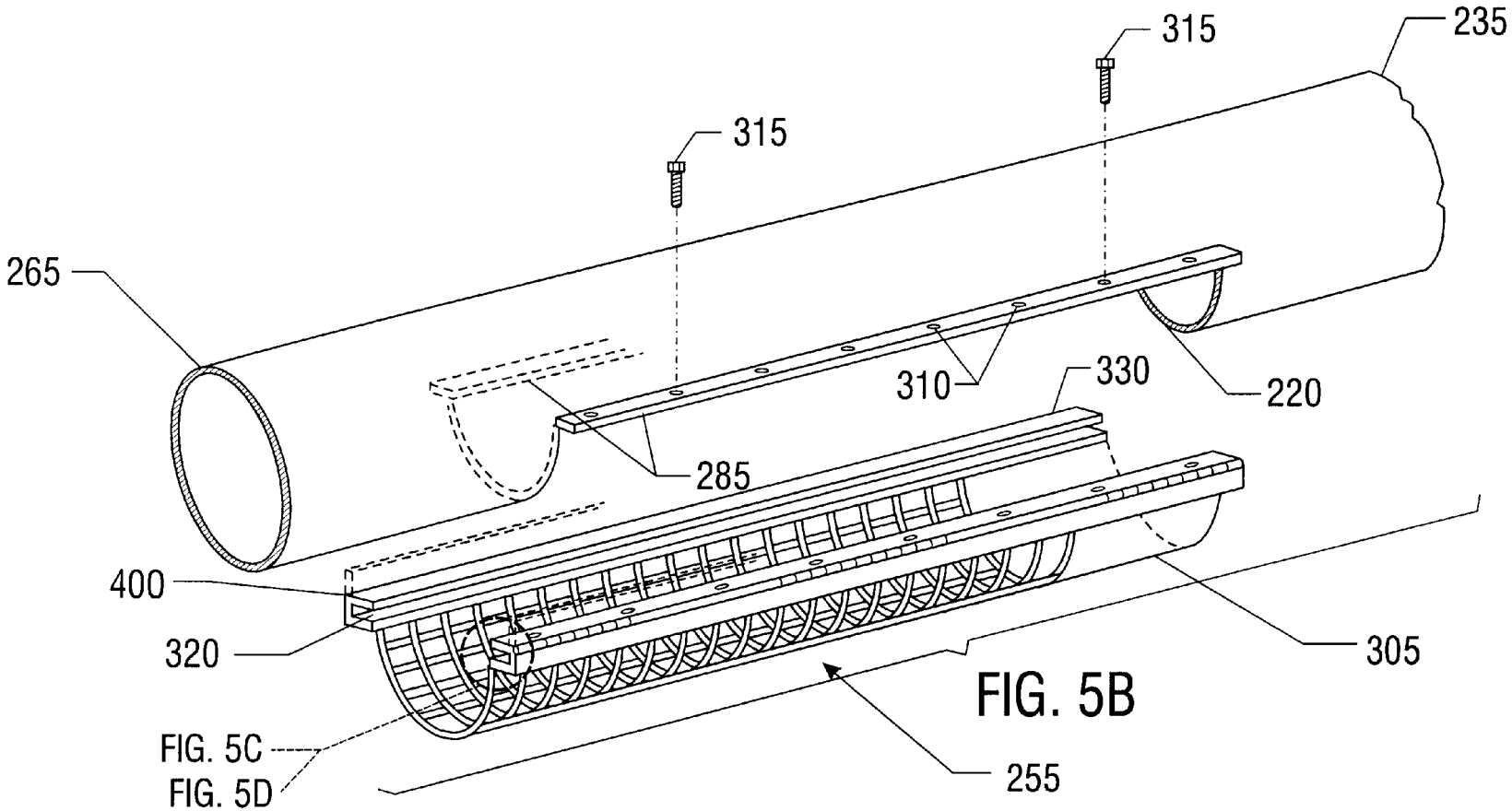

FIGS. 5A and 5B illustrate an isometric view of the removable grate 255 and a section 325 of the housing 205 of the padder 200 to which the removable grate 255 attaches. As shown in FIG. 5B, one end of the grate 255 may be a solid plate 305, which allows the effective size of the first outlet 220 to be varied by slideably positioning the grate 255 to a desired location. To adjust the point of deposition, the grate 255 can be relocated towards the inlet end 235, whereby the solid plate 305 now covers a portion of the outlet 220 and decreasing the amount of backfill material (240—see FIG. 2) that falls into the open trench 20. Alternatively, by utilizing a solid plate on both ends of the grate 255, it is possible to move the point of deposition in either direction along the length of housing 205. FIG. 5B illustrates the two external rails 285 attached to the housing of the padder 200 having a plurality of holes 310 used for aligning the grate 255 at various positions with respect to the first outlet 220. Screws, bolts or the like 315 are then utilized to secure the grate 255 in place and also allow easy removal and replacement with an alternative grid having a different size opening. The removable grate arrangement of FIGS. 5A–5D may be used on all embodiments of the present invention.

Figure 5C:
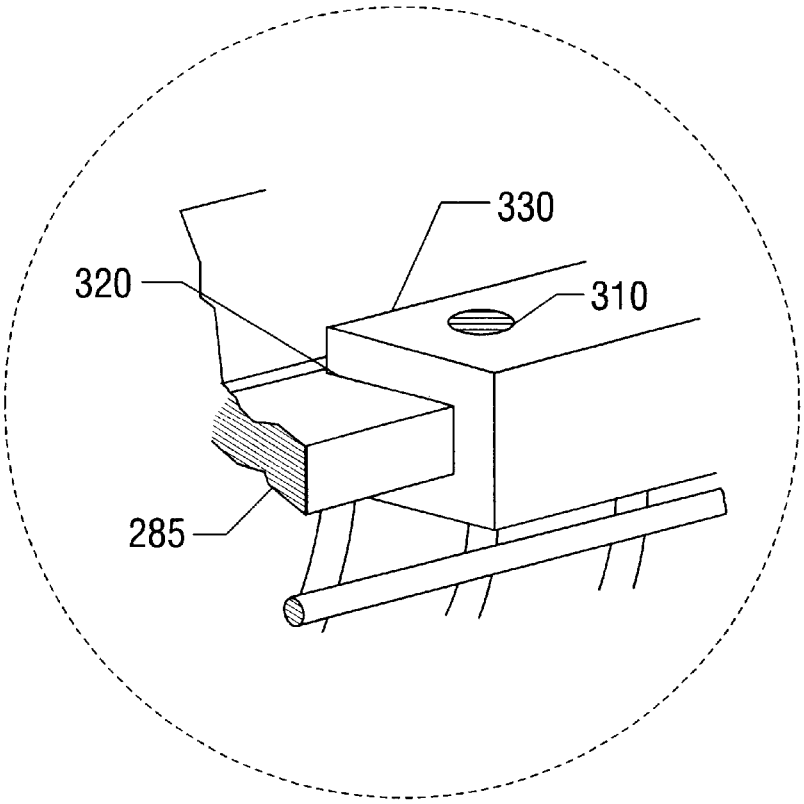
FIGS. 5C–D are exploded isometric views of the movable grate attached to the external rails of the padder of FIG. 2.
Figure 5D:
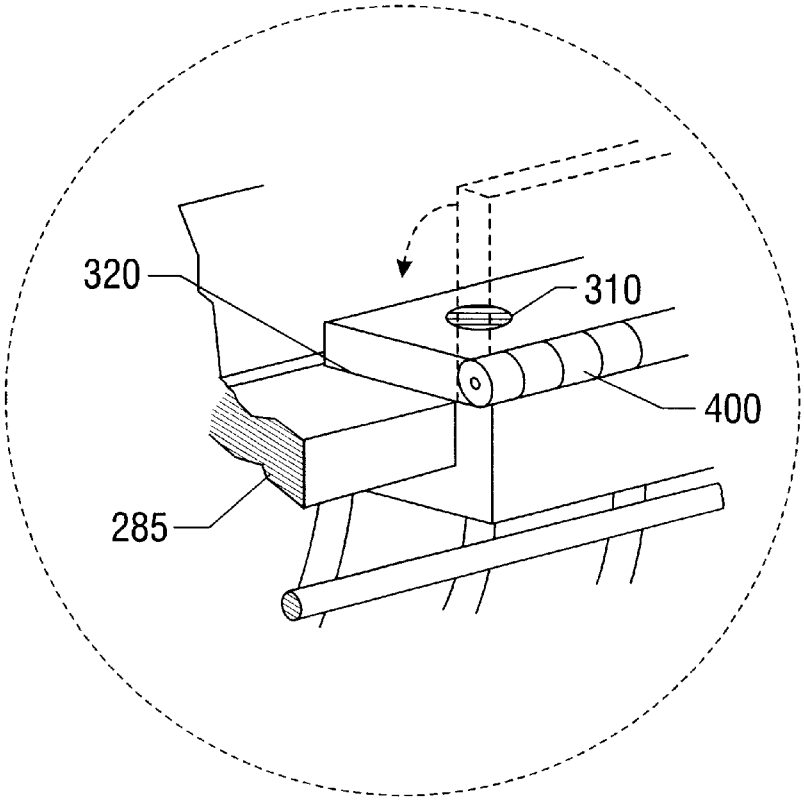

FIGS. 5C and 5D show an enlarged isometric view of two embodiments for mounting the removable grate 255 to the external rails 285. As illustrated in FIG. 5C, the external rail 285 slides into a groove 320 of a rectangular-shaped bar 330 located on each edge of the grate 255, where the groove 320 is adapted to fit the external rail 285. FIG. 5D depicts an alternate means for mounting the movable grate 255 to the external rails 285. The alternate means includes a hinge 400 that folds and clamps to the external rail 285. The advantage derived from using a hinge 400 is that it not only preserves the movability of the grate 255 but it also facilitates the process of swapping grates. The grate 255 no longer has to slid along the length of the external rails 285 before it can be removed, which can be problematic if the two ends 235, 265 of the padder 200 extend radially outward so as to prohibit the grate 255 from sliding out.

This embodiment of the present invention provides an apparatus for padding the pipeline 45 with fines (260—see FIG. 2) extracted from the backfill material 30 running along the trench 20. The padding can be accomplished by removably attaching one end 235 of the padder 200 laterally to the boom 10 of the prime mover (not shown), which works in the backfill 30 and does not reach across the open trench 20. The padder 200 is pushed through the backfill material 30 parallel with the open trench 20. Because the prime mover (not shown) is attached to the padder 200 near the end with the inlet grizzly 235, the padder 200 is subjected to minimal torque as the prime mover (not shown) traverses the backfill 30.

Alternatively, padder 200 can be operated by simply raising padder 200 above the backfill material mound and then lowered downwardly into the bank without substantial movement of the prime mover through the backfill while using the padder. Such an operation would simply force the inlet assembly vertically into the backfill material and extract material for padding. After material has been extracted and deposited, the padder 200 would be lifted substantially vertically out of the backfill material, moved to a second location of the bank and, again, lowered into the backfill material. Such operation could be used to construct bench pads as previously described in connection with the embodiment of FIG. 1. Of course, such an operation would require that the inlet grizzly assembly 215 be oriented move toward the bottom portion of housing 205 Thus, the embodiment of FIG. 2 can be used as a continual padder or for spot or selected padding.

Figure 4:
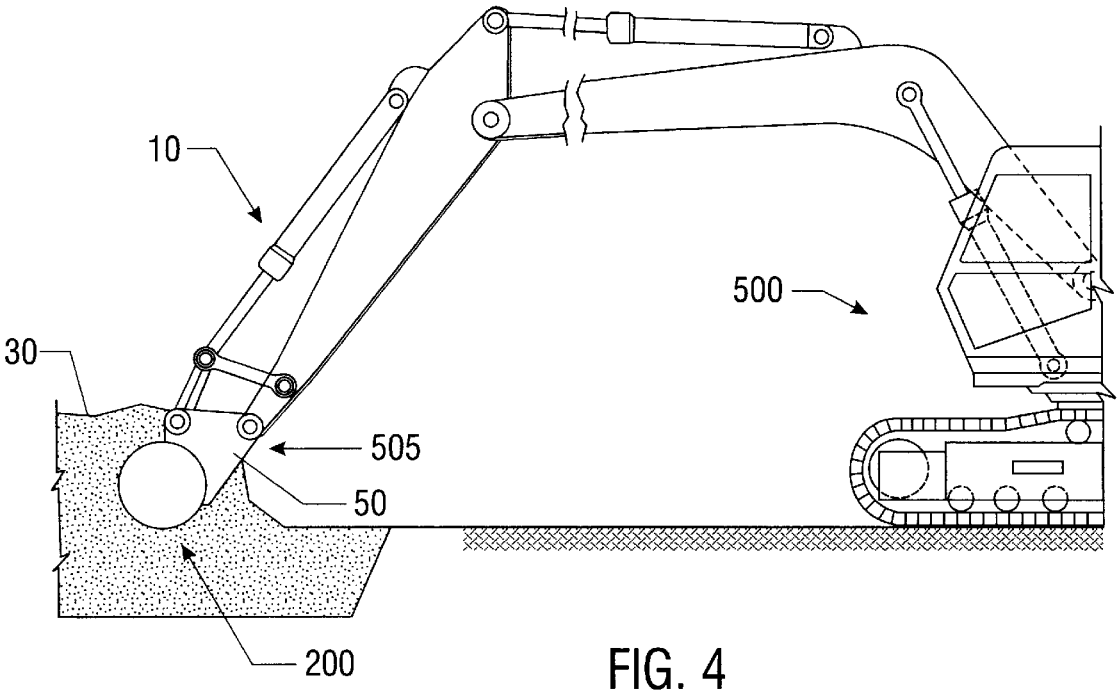
FIG. 4 is a side view of the padder of FIG. 2 attached to an excavator.
Figure 6:
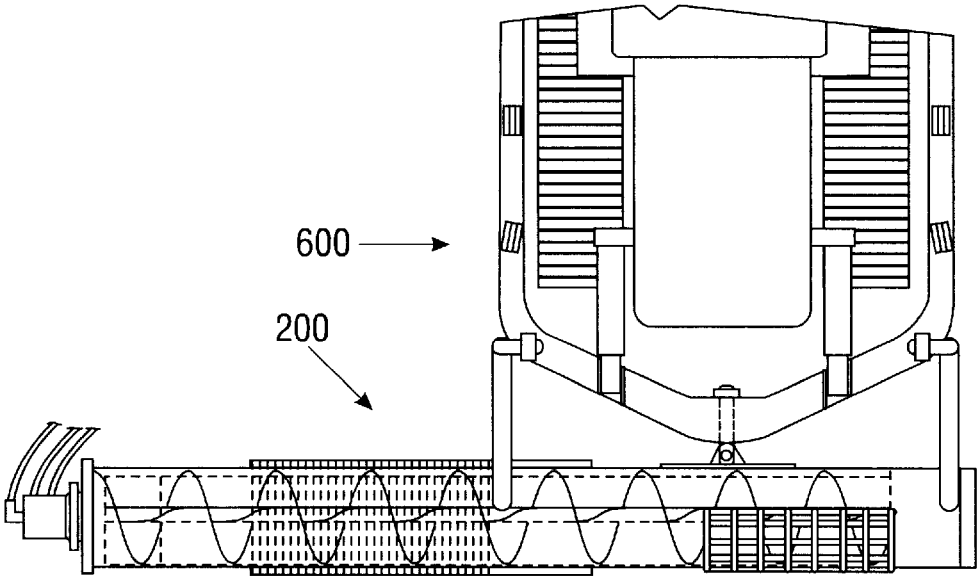
FIG. 6 is a top view of the padder of FIG. 2 attached to a tractor.
Figure 7:
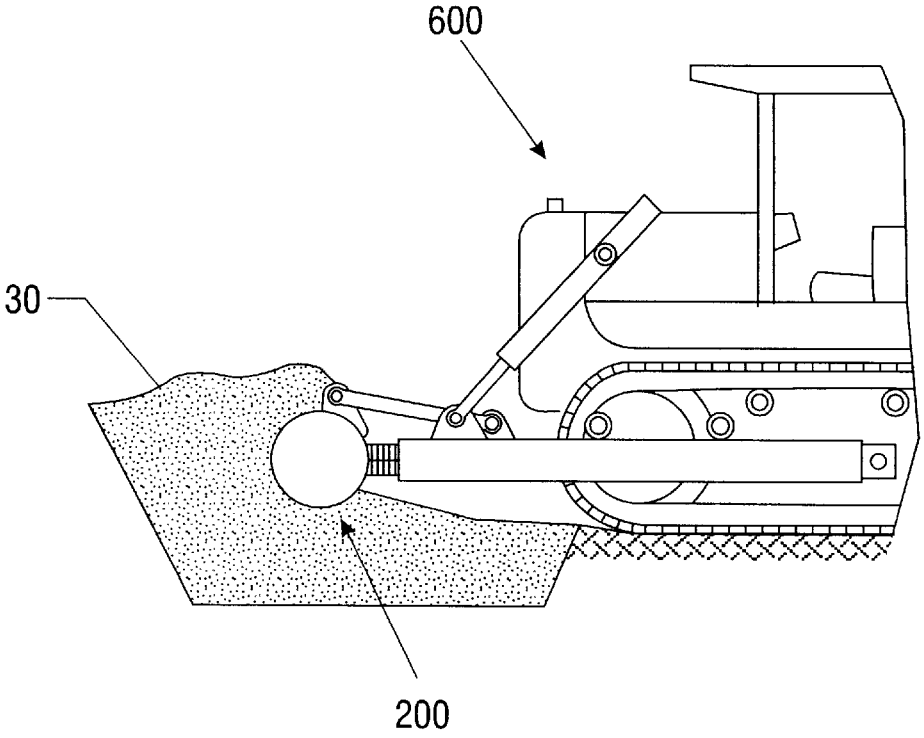
FIG. 7 is a side view of the padder of FIG. 2 attached to a tractor.

As mentioned earlier, the padder 200 is attachable to any prime mover, such as to a boom 10 of a conventional excavator, backhoe, bulldozer, tractor or the like. For example, FIG. 4 and FIG. 7 illustrate one method of mounting the padder 200 of the present invention to an excavator 500 and a track-type tractor 600, respectively. As shown in FIG. 4, a bracket of two planar plates 505 are affixed to the housing 205 and include pivot holes so as to pivotally connect the boom 10. FIG. 7 depicts a simplified side elevational view of the padder 200 attached to the tractor 600. FIG. 3 and FIG. 6 provide a top view of the attachments to the excavator 500 and tractor 600, respectively. It should be apparent to those skilled in the art that the padder 200 of the present invention can be mounted to a variety of prime movers in a variety of ways to achieve the intended purposes of the present invention.

Those skilled in the art will also appreciate that while the apparatus disclosed in the present invention may employ one inlet and two outlets for padding, a padder having only one inlet and outlet can also achieve the desired results. That is, the inlet can serve as a one-step screen allowing only material acceptable for padding into the housing of the padder. All padding material passed through the inlet assembly would then be directly deposited in the open trench through the first outlet. The present invention can be utilized for not only padding pipelines but also for padding other devices, such as cables, telephone lines, storage tanks, or the like.

Additionally, although the embodiments of the present invention disclose an auger for transporting the backfill material down the housing of the padder, those skilled in the art will appreciate that other means, such conveyor belts, for example, can also be employed to transport the padding material. Furthermore, it should be apparent that the means for transporting the padding material can be accomplished using not only hydraulic power, but also electric power, or any other available power source.

The particular embodiments disclosed above are illustrative only, as the invention may be modified and practiced in different by equivalent manners apparent to those skilled in the art having the benefit of the teachings herein. For example, housing 205 may be of a shape other than circular in cross-section such as square or rectangular. The housing also may be an open trough or the like. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A padding machine for extracting padding material of a maximum predetermined size from excavated material removed from an open trench and depositing at least a portion of said padding material at a selected location in the trench to form a bench pad, the apparatus to be mounted to a vehicle which may be located near a side of the trench, said apparatus comprising:

an elongated housing having a first and a second end, the first end having a tapered head fixed thereto whereby the head and first end of the housing may be inserted directly into the excavated material removed from the trench;

an inlet assembly formed in the housing proximate the first end of the housing and adapted for allowing a portion of the excavated material to pass through the inlet assembly and into the housing when the head and first end is inserted sufficiently into the excavated material;

a conveyor assembly mounted in the housing and positioned for receiving the extracted portion and conveying the extracted portion toward the second end of the housing;

a first outlet assembly formed in the housing between the first and second ends of the housing for receiving at least a portion of the extracted portion and depositing the portion of the extracted portion into the trench; and a screen assembly having openings of the maximum predetermined size to allow particles less than the maximum predetermined size in the excavated material to pass through said screen assembly and be used as padding material, said screen assembly connected to the housing and forming a part of the inlet assembly or first outlet assembly.

2. The apparatus of claim 1, wherein the housing is generally cylindrical and includes an internal chamber wherein the conveyor assembly is mounted.

3. The apparatus of claim 1, wherein the inlet assembly comprises said screen assembly and an inlet opening formed in the housing, said screen assembly connected across at least a portion of said inlet opening whereby said screen openings prevent particles of the excavated material greater than said predetermined size from passing through the screen into the housing.

4. The apparatus of claim 1, wherein the conveyor assembly includes an auger rotatably mounted between the first and second ends of the housing.

5. The padding apparatus of claim 1, wherein the apparatus further includes a second outlet assembly formed in the housing proximate the second end of the housing and positioned for receiving from the conveyor assembly that portion of the extracted portion not received by the first outlet assembly, and discharging said portion not received by the first outlet assembly and from the housing.

6. The apparatus of claim 1, wherein the first outlet assembly includes said screen assembly and a first outlet opening formed in the housing, said screen assembly attached to the housing across at least a portion of said first outlet opening whereby said screen openings prevent particles in the extracted material greater than the predetermined size from passing through the screen assembly and being discharged from the apparatus as padding material.

7. The apparatus of claim 6, wherein the first outlet assembly includes a pair of substantially parallel rails attached to the housing on opposed sides of the first outlet opening; and said screen assembly removably mounted to the rails and across the first outlet opening.

8. The apparatus of claim 7, wherein at least a portion of the screen assembly does not include any openings so that the screen assembly may be selectively positioned along the rails to a location where at least a portion of the screen assembly which does not include openings is placed over at least a portion of the first outlet opening thereby partially blocking the passage of extracted material from that portion of the outlet opening.

9. The apparatus of claim 1, further including an attachment bracket connected to the housing for attaching the apparatus to the vehicle.

10. The apparatus of claim 1, wherein the apparatus is pivotally attached to the end of a boom on the vehicle.

11. An apparatus for obtaining padding material of a maximum predetermined size from the excavated material removed from a trench or similar cavity and depositing the padding material into the cavity, the apparatus to be mounted to a vehicle which may be positioned near a side of the cavity, said apparatus comprising:

an elongated housing having a first and a second end;

an inlet assembly formed in the housing proximate the first end of the housing and adapted for receiving an extracted portion of the excavated material;

a conveyor assembly mounted to the housing and positioned for receiving the extracted portion from the inlet assembly and conveying the extracted portion toward the second end of the housing;

a first outlet assembly formed in the housing between the first and second ends of the housing for receiving at least a portion of the extracted portion and depositing the portion of the extracted portion into the cavity;

a screen assembly having openings of the maximum predetermined padding material size to allow particles in the excavated material less than the maximum predetermined size to pass through the screen assembly, said screen assembly mounted to the housing and forming a part of the inlet assembly or the first outlet assembly; and a substantially conical shaped head portion fixedly attached to the first end of the housing and adapted for being inserted into the excavated material to a depth sufficient to allow the extracted portion to be received by the inlet assembly.

12. The apparatus of claim 11, wherein the housing is generally cylindrical and includes an internal chamber wherein the conveyor assembly is mounted.

13. The apparatus of claim 11, wherein the inlet assembly comprises said screen assembly and an inlet opening formed in the housing, said screen assembly connected across at least a portion of said inlet opening whereby said screen openings prevent particles of the excavated material greater than said predetermined size from passing through the screen assembly and inlet opening into the housing.

14. The apparatus of claim 11, wherein the conveyor assembly includes an auger rotatably mounted between the first and second ends of the housing.

15. The padding apparatus of claim 11, wherein the apparatus further includes a second outlet assembly formed in the housing proximate the second end of the housing and positioned for receiving from the conveyor assembly that portion of the extracted portion not received by the first outlet assembly, and discharging said portion not received by the first outlet means from the housing.

16. The apparatus of claim 11, wherein the first outlet assembly includes said screen assembly and a first outlet opening formed in the housing, said screen assembly attached to the housing across at least a portion of said first outlet opening whereby said screen openings prevent particles in the extracted material greater than the predetermined size from passing through the screen assembly and being discharged from the apparatus as padding material.

17. The apparatus of claim 16, wherein the first outlet assembly includes a pair of substantially parallel rails attached to the housing on opposed sides of the first outlet opening; and said screen assembly removably mounted to the rails and across the first outlet opening.

18. The apparatus of claim 17, wherein at least a portion of the screen assembly does not include any openings so that the screen assembly may be selectively positioned along the rails to a location where at least a portion of the screen assembly which does not include openings is placed over at least a portion of the first outlet opening thereby partially blocking the passage of extracted material from that portion of the outlet opening.

19. The apparatus of claim 11, further including an attachment bracket connected to the housing for attaching the apparatus to the vehicle.

20. The apparatus of claim 11, wherein the apparatus is pivotally attached to the end of a boom on the vehicle.

21. A vehicle for obtaining padding material of a maximum predetermined size from the excavated material removed from a trench or similar cavity, the vehicle which may be positioned near a side of the cavity during operation, comprises:

a prime mover;

a mounting bracket attached to the prime mover; and a padding machine attached to the mounting bracket, said padding machine comprises:

an elongated housing having a first and a second end;

an inlet assembly formed in the housing proximate the first end of the housing and adapted for receiving an extracted portion of the excavated material;

a conveyor assembly mounted to the housing and positioned for receiving the extracted portion from the inset assembly and conveying the extracted portion toward the second end of the housing;

a first outlet assembly formed in the housing between the inlet assembly and the second end of the housing for receiving at least a portion of the extracted portion and depositing the portion of the extracted portion into the cavity;

a tapered head portion fixedly attached to the first end of the housing and adapted for being inserted into the excavated material to a depth sufficient to allow the extracted portion to be received by the inlet assembly; and a screen assembly having openings of the maximum predetermined size to allow particles less than the maximum predetermined size in the excavated material to pass through the screen assembly and be used as padding material, said screen assembly connected to the housing and forming a part of the inlet assembly or the first outlet assembly.

* * * * *

UNITED STATES PATENT AND TRADEMARK OFFICE

CERTIFICATE OF CORRECTION

PATENT NO. : 6,029,378

DATED : February 29, 2000

INVENTOR(S) : Thomas J. Cronk, Jr.

It is certified that error appears in the above-identified patent and that said Letters Patent is hereby corrected as shown below:

Col. 9, line 46, delete "and".

Signed and Sealed this

Nineteenth Day of December, 2000

*Attest:*

Q. TODD DICKINSON

*Attesting Officer*

*Commissioner of Patents and Trademarks*